US011412598B2

(12) United States Patent
Eski et al.

(10) Patent No.: US 11,412,598 B2
(45) Date of Patent: Aug. 9, 2022

(54) SYSTEMS AND METHODS FOR ADJUSTING LIGHT OUTPUT

(71) Applicant: Nanogrid Limited, Sheung Wan (CN)

(72) Inventors: Aliakbar Juzer Eski, Mississauga (CA); Nathan Dyck, Toronto (CA); Lei Zhang, Toronto (CA)

(73) Assignee: Nanogrid Limited, Sheung Wan (HK)

( * ) Notice: Subject to any disclaimer, the term of this patent is extended or adjusted under 35 U.S.C. 154(b) by 0 days.

(21) Appl. No.: 16/788,006

(22) Filed: Feb. 11, 2020

(65) Prior Publication Data

US 2020/0260557 A1 Aug. 13, 2020

Related U.S. Application Data

(60) Provisional application No. 62/803,976, filed on Feb. 11, 2019.

(51) Int. Cl.

| | |
|---|---|
| ***H05B 47/11*** | (2020.01) |
| ***H05B 47/175*** | (2020.01) |
| ***H05B 45/20*** | (2020.01) |
| ***H05B 45/10*** | (2020.01) |

(52) U.S. Cl.

CPC ..... *H05B 47/11* (2020.01); *H05B 45/10* (2020.01); *H05B 45/20* (2020.01); *H05B 47/175* (2020.01)

(58) Field of Classification Search

CPC ..... H05B 45/10; H05B 47/11; H05B 47/19; H05B 45/20; H05B 47/105; H05B 47/175; H05B 45/37; H05B 47/16; H05B 47/12; H05B 45/00; H05B 47/18

USPC ..... 315/297, 307, 152, 224, 246

See application file for complete search history.

(56) References Cited

U.S. PATENT DOCUMENTS

| | | | | |
|---|---|---|---|---|
| 2009/0278034 | A1* | 11/2009 | Ackermann | H01L 31/02322 250/227.11 |
| 2011/0084614 | A1* | 4/2011 | Eisele | H05B 47/10 315/152 |
| 2012/0235579 | A1* | 9/2012 | Chemel | F21V 21/30 315/152 |
| 2016/0323972 | A1* | 11/2016 | Bora | H05B 45/24 |
| 2018/0012137 | A1* | 1/2018 | Wright | G05B 15/02 |
| 2018/0084617 | A1* | 3/2018 | Zhang | A61N 5/0616 |
| 2020/0052997 | A1* | 2/2020 | Ramanathan | H04L 69/22 |

* cited by examiner

*Primary Examiner* — Wei (Victor) Y Chan

(74) *Attorney, Agent, or Firm* — Norton Rose Fulbright US LLP

(57) ABSTRACT

Embodiments of the present disclosure generally relate to the field of controlling light output, and more specifically, embodiments relate to devices, systems and methods for modulating output brightness levels of a system based on ambient light input. In particular, systems and methods for compensating for light feedback are described, along with systems and methods for determining output lighting states based on relative light levels, and methods for calibration of self-feedback values.

16 Claims, 7 Drawing Sheets

SYSTEMS AND METHODS FOR ADJUSTING LIGHT OUTPUT

CROSS-REFERENCE

This application is a non-provisional of, and claims all benefit including priority to, U.S. Application No. 62/803,976, entitled "SYSTEMS AND METHODS FOR ADJUSTING LIGHT OUTPUT", filed Feb. 11, 2019, incorporated herein by reference.

FIELD

Embodiments of the present disclosure generally relate to the field of controlling light output, and more specifically, embodiments relate to devices, systems and methods for modulating output brightness levels of a system based on ambient light input.

INTRODUCTION

Modulating output brightness levels of a system based on ambient light input is a technically challenging endeavor, as multiple considerations must be accounted for. In particular, maintaining aesthetic uniformity is challenging, especially in view of light feedback (e.g., from reflections, internal structures).

SUMMARY

Controllable lighting is desirable, and lighting devices having adjustable light output adapted for control in accordance with modulating output brightness levels of a system based on ambient light input are particularly useful where calibration is important.

In a modular system of light output devices (e.g., LED light panels), one or more panel modules can include a light sensor for the purposes of modulating output brightness level of the system based on ambient light input. The light sensor is a photoelectric device which is adapted to measure one or more light characteristics, such as luminous intensity (e.g., Candela), an amount of visible light (e.g., Lumen), an amount of visible light that falls on a surface (e.g., Lux), and can include photoresistors (such as a light-dependent resistor), photodiodes, and phototransistors, among others.

To maximize aesthetic uniformity between modules, the light sensor is placed behind optical elements within the panel, hidden from direct view by an observer (e.g., for aesthetic purposes such that the modular lighting appears to the observers as a fully lit object). This introduces light feedback from the lighting elements (e.g., LEDs) in the panel that must be factored out to obtain accurate readings that reflect true ambient light levels in a room coming from other light sources. Having the light sensor obstructed yields technical challenges from a sensory perspective and a specific approach for calibration is described in various embodiments that allows for a practical implementation of lighting devices where the sensor is placed behind the optical elements within the panel.

Further, if the internal lighting elements (e.g., LEDs) are in transition, either in terms of output brightness or in terms of output colour, this can further complicate absolute readings from an ambient light sensor. Accordingly, there are technical challenges in respect of obtaining accurate readings from the light sensor, and these challenges can impede the usefulness of the light sensor in relation to practical applications, such as generating accurate control signals for the adjustment of light output.

As described in various embodiments, compensation mechanisms are provided that aid in reducing or eliminating effects of light feedback.

In an embodiment, there is provided a controller circuit adapted for controlling a light output of a lighting device, the controller circuit including: one or more internal light sensors configured to generate one or more internal light sensor readings at different output colours in a constant ambient brightness setting, the one or more internal light sensor readings recorded as one or more calibration values. The controller circuit can include a printed circuit board (useful for mass manufacturing), a configured field-programmable gate array (e.g., for flexibility in deployment), and an application-specific integrated circuit, among others (e.g., for deployment in larger volumes). The application-specific integrated circuit embodiment can be provided, for example, as a system-on-chip (SoC).

A processor is configured to: determine one or more time periods where a light output of the lighting device is known and stable; obtain a measurement from a light sensor of the one or more internal light sensors; determine a calibration value of the one or more calibration values corresponding to the measurement from the light sensor; scale the calibration value with a current user brightness setting value; subtract the calibration value from the measurement to provide an adjusted ambient brightness value; and generate signals adapted for controlling the light output of the lighting device based at least on the adjusted ambient light value.

The processor can include a hardware processor, such as a computer processor that operates in conjunction with computer memory and/or data storage. The processor can be adapted for interoperation with network interfaces (e.g., input/output pins, message buses, interrupt handlers). Control signals can include signals transmitted across analog signals, or digital signals, and control can be established through the variation of electrical characteristics, such as modifying the voltage experienced at a node across a message bus. The processor can also be adapted to encapsulate the control signal in the form of data packets for transmission to a lighting device, for example, encapsulated for transmission on protocols such as ZigBee™, Bluetooth™, WiFi (e.g., 802.11x), among others.

In another embodiment, the controller circuit includes a processor configured to: based on a user input value, determine a type of lighting output state desired by a user; based on the user input value, determine a brightness level desired, including at least a minimum and a maximum value; track an adjusted ambient brightness level observed by a sensor, the tracking including tracking a minimum and a maximum brightness level; determine an offset for output brightness determined at least by an ambient light level at a time proximate to a time when the user has established a brightness level; and generate signals adapted for controlling the light output of the lighting device to adjust an output brightness of the lighting device along a lighting curve, adjusted based on the offset.

The system of some embodiments is configured to interoperate and control lighting provided by one or more lighting devices of an electronically coupled set of modular lighting display elements. The electronically coupled set of modular lighting display elements include lighting modules that are adapted to generate one or more effects by operating in concert based on synchronized control signals, which, for example, can propagate through one or more lighting controller devices.

Each of the lighting modules can include lighting panels (e.g., substantially planar lighting panels) which may otherwise encounter issues relating to light feedback, and include one or more internal light sensors that are operable to provide compensation and control as described in various embodiments herein.

Corresponding methods, apparatuses and non-transitory computer readable media (e.g., computer program products in the form of machine interpretable instructions that can be executed by a processor such that the processor performs a corresponding method) are contemplated.

DESCRIPTION OF THE FIGURES

In the figures, embodiments are illustrated by way of example. It is to be expressly understood that the description and figures are only for the purpose of illustration and as an aid to understanding.

Embodiments will now be described, by way of example only, with reference to the attached figures, wherein in the figures.

DETAILED DESCRIPTION

As described in various embodiments, compensation mechanisms are provided that aid in reducing or eliminating effects of light feedback.

Modulating output brightness levels of a system based on ambient light input is a technically challenging endeavor, as multiple considerations must be accounted for. To maximize aesthetic uniformity between modules, in some embodiments, the light sensor is placed behind optical elements within the panel, hidden from direct view by an observer (e.g., for aesthetic purposes such that the modular lighting appears to the observers as a fully lit object).

This introduces light feedback from the lighting elements (e.g., LEDs) in the panel that must be factored out to obtain accurate readings that reflect true ambient light levels in a room coming from other light sources.

Having the light sensor obstructed yields technical challenges from a sensory perspective and a specific approach for calibration is described in various embodiments that allows for a practical implementation of lighting devices where the sensor is placed behind the optical elements within the panel. Further, if the internal LEDs are in transition, either in terms of output brightness or in terms of output colour, this can further complicate absolute readings from an ambient light sensor. Accordingly, there are technical challenges in respect of obtaining accurate readings from the light sensor, and these challenges can impede the usefulness of the light sensor in relation to practical applications, such as generating accurate control signals for the adjustment of light output.

Figure 1:
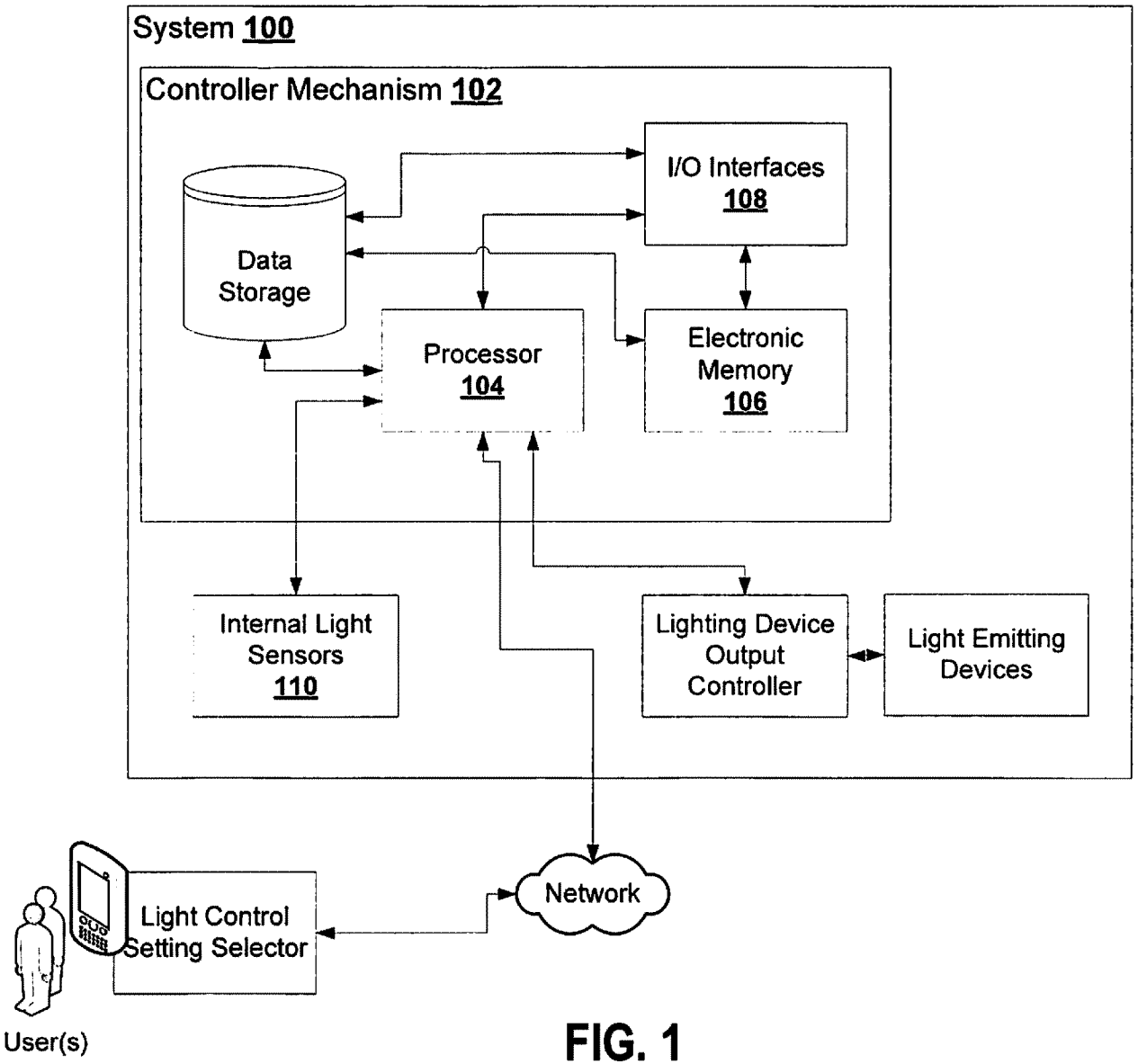
FIG. 1 is a block schematic diagram of an example lighting system, according to some embodiments.

FIG. 1 is a block schematic diagram of an example lighting system, according to some embodiments.

The system 100 of FIG. 1 is configured to interoperate and control lighting provided by one or more lighting devices of an electronically coupled set of modular lighting display elements.

The electronically coupled set of modular lighting display elements include lighting modules that are adapted to generate one or more effects by operating in concert based on synchronized control signals, which, for example, can propagate through one or more lighting controller devices.

Each of the lighting modules can include lighting panels (e.g., substantially planar lighting panels) which may otherwise encounter issues relating to light feedback, and include one or more internal light sensors that are operable to provide compensation and control as described in various embodiments herein.

A controller mechanism 102 is provided that can reside within lighting panels, or within an external coupled controller. The controller mechanism 102 is in electronic communication with lighting devices, and provides control signals to control lighting output characteristics of the lighting devices. The controller mechanism 102 can be a controller circuit, such as a controller circuit board, in some embodiments, and may include a processor 104, electronic memory 106, and input/output interfaces 108. The processor 104 can be, for example, a field programmable gate array, a processor element on a printed circuit board, among others. The electronic memory 106 can include read only memory, random access memory, among others, and may store machine-readable instructions thereon for execution by processor 104. The input/output interfaces 108 includes electronic interfaces and/or network interfaces, which are utilized for data communications, such as control signals transferred to lighting output controllers that control lighting characteristics of the light provided by the lighting devices.

The system 100 can include one or more internal light sensors 110 configured to generate one or more internal light sensor readings at different output colours in a constant ambient brightness setting, the one or more internal light sensor readings recorded as one or more calibration values. In a variation, the light sensors can include non-internal light sensors, such as light sensors that are placed at external positions to a particular lighting device (e.g., a network coupled light sensor) or light sensors that are internal to other lighting devices or other lighting systems. For example, in a smart home setup, there can be multiple lighting systems that may or may not be connected to another, each being coupled to light sensors that may be internal to the lighting devices themselves (e.g., in the luminaire) or external, and the light sensors may be positioned such that the lighting systems provide distributed lighting/illumination across the home, and sensed light from the light sensors can be used, for example, to maintain a constant illumination level despite variations in ambient lighting as time passes or due to the presence of external factors, such as cloud movement.

Accordingly, while some embodiments described are in relation to internal light sensors, some variant embodiments are contemplated where light sensors may include internal light sensors, external light sensors, and light sensors that are internal other lighting systems that are distributed across a premise (e.g., a home).

The lighting devices have elements therein that provide controllable lighting that can be adjustable, for example, through modifying lighting output characteristics. For example, a lighting element may include multiple LEDs which operate in conjunction to provide lighting of various colours (e.g., 3 LEDs that operate together in conjunction with a microcontroller orchestrating operation). The output from the LEDs can be modified, for example, by varying aspects of power flow to each of the LEDs, or activating structural aspects (e.g., actuating filters), among others, which can modify how lighting is produced in aggregate.

The lighting elements described in embodiments herein are adjustable at least in respect of brightness, and in other embodiments, are adjustable in terms of colour. As the lighting elements adjust, in some embodiments, the lighting elements transition between colours by smoothly interpolating intermediate colours by, for example, shifting values gradually from an initial state to a target state. The approaches described herein are directed to the use of lighting sensors in conjunction with controllable lighting elements to automatically adjust the lighting output.

If the internal lighting elements of the lighting devices are in transition (e.g., LEDs are shifting from bright red to dimmed green), either in terms of output brightness or in terms of output colour, this can further complicate absolute readings from an ambient light sensor. In order to factor these items out, the system 100 is configured to apply the following process using processor 104.

Variations are contemplated, and steps may be conducted in various orders and different, alternate, and modified steps are possible.

Figure 2B:
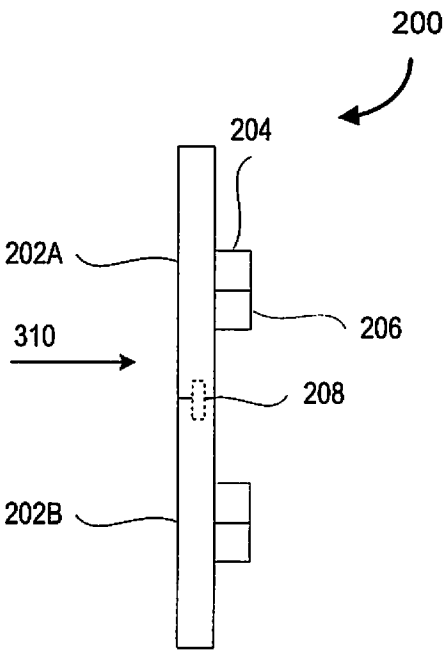
FIG. 2B is a side view of the example modular system, according to some embodiments.
Figure 2A:
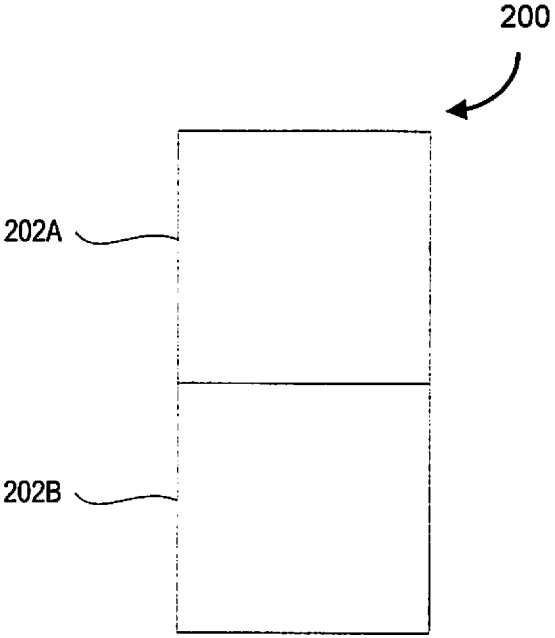
FIG. 2A is a front view of an example modular system of lighting devices (e.g., LED light panels)

FIG. 2A is a front view of an example modular system 200 of lighting devices (e.g., LED light panels), and FIG. 2B is a side view of the example modular system 200, according to some embodiments. As shown in FIG. 2A, the example modular system 200, upon direct view of an observer, is only panels 202A and 202B, which are devices where light is output from. It is important to note that the example modular system 200, upon direct view of an observer provides a lit panel that is uniformly lit (e.g., although individual subsections can be lit with different colors, the entirety of the panel is lit).

As shown in FIG. 2B, these panel systems include ambient light sensor 204 and/or a power/control circuit 206, which can include controller mechanism 102 (e.g., as a controller circuit). In a variant embodiment, the controller mechanism 102 is a separate circuit that is coupled to a plurality of power/control circuits 206. In yet another variant embodiment, The panels 202A and 202B can be connected through a connecting circuit coupler 208, which can, in some embodiments, electrically interconnect panels 202A and 202B such that power and/or data can be transferred amongst one another.

Figure 3:
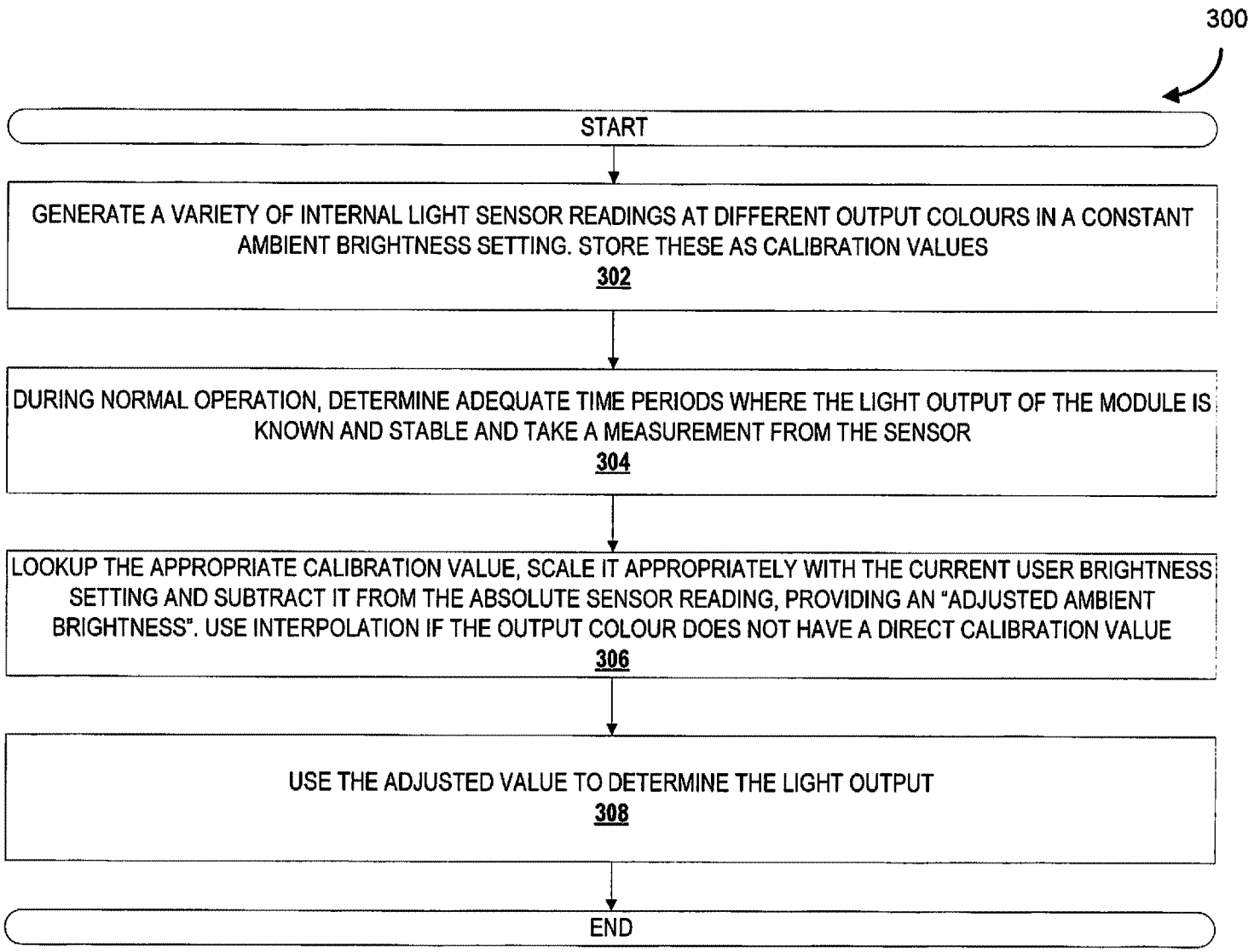
FIG. 3 is a method diagram of a method for determining light output in relation to an adjusted ambient brightness when lighting panels are in transition using the light sensor, according to some embodiments.

A set steps are shown at FIG. 3, which shows a method 300 for determining light output using the light sensor 204. Variations are contemplated, and steps may be conducted in various orders and different, alternate, and modified steps are possible.

1. At 302, the processor controls the light sensor 204 and power/control circuit 206 to generate a variety of internal light sensor readings at different output colours in a constant ambient brightness setting. These are stored as calibration values, for example, in a coupled local data storage (e.g., on-board flash memory), or a networked data storage (e.g., coupled to one of the panels and communicated through a messaging bus established across the panels in aggregate).
2. At 304, during normal operation, the power/control circuit 206 is configured to determine adequate time periods where the lighting (e.g., LED) output of the module is known and stable and take a measurement from the sensor.
3. At 306, the power/control circuit 206 conducts a look-up of the the appropriate calibration value, scales it appropriately with the current user brightness setting and subtracts it from the absolute sensor reading, providing an "adjusted ambient brightness". The power/control circuit 206 can be configured to use interpolation if the output colour does not have a direct calibration value.
4. At 308, the power/control circuit 206 uses the adjusted value to determine the light output. The light output can be controlled in relation to an adjusted ambient brightness whereby the light sensor signals are corrected to remove the contribution of the lighting output of the panels 202A or 202B themselves.

Figure 4:
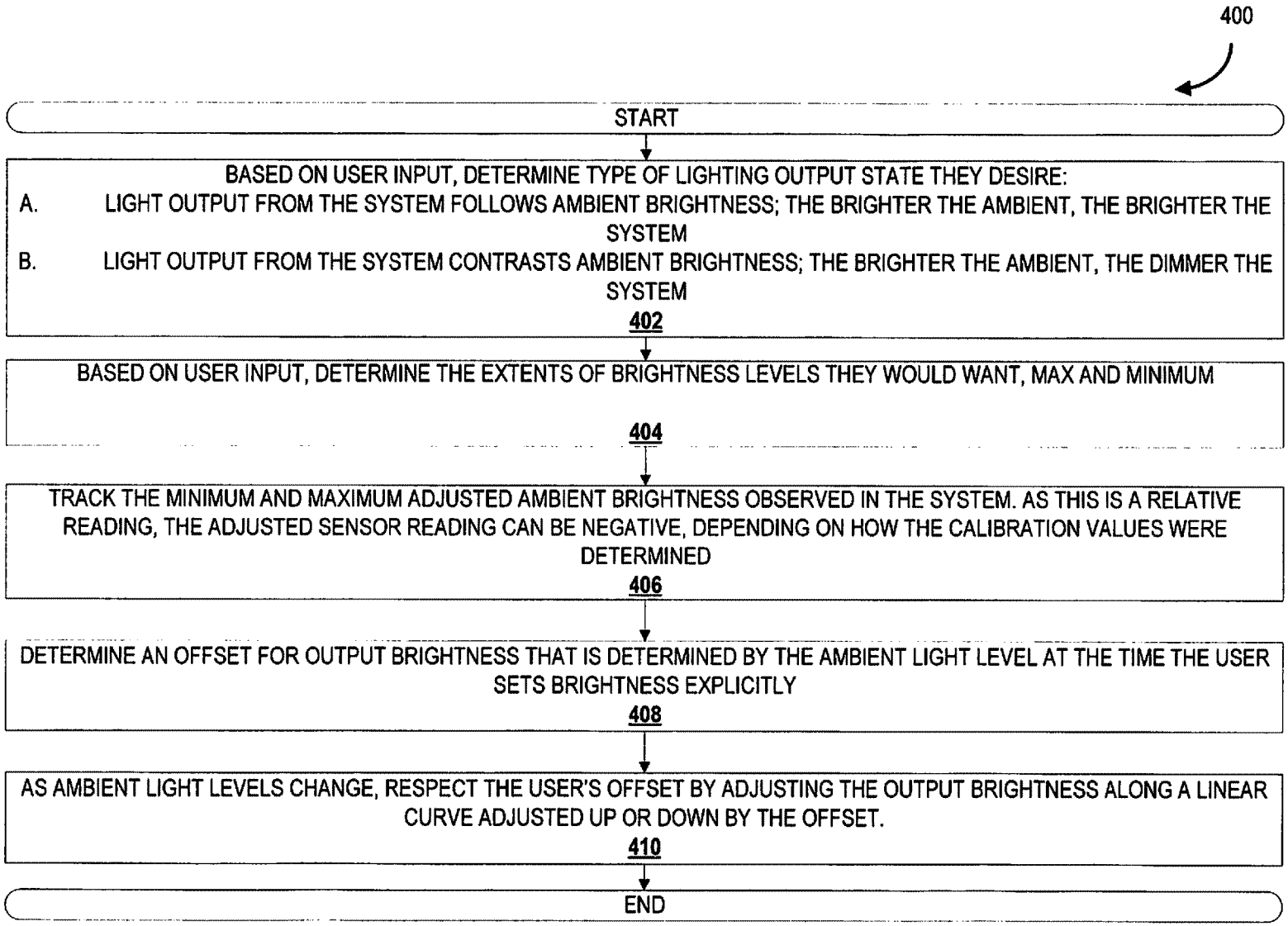
FIG. 4 is a method diagram of a method for adjusting light output using the light sensor based on a determined offset, according to some embodiments.

FIG. 4 is an example method 400 shown in relation to determining output lighting states based on relative light levels is described that is free of the need to convert to an accurate ambient lighting level unit such as Lux, for example, according to some embodiments.

Variations are contemplated, and steps may be conducted in various orders and different, alternate, and modified steps are possible.

The method 400 is summarized (there may be different, alternate, modified steps) as:

1. At 402, based on user input, the power/control circuit 206 determines a type of lighting output state desired:
   a. Light output from the system follows ambient brightness; the brighter the ambient, the brighter the system
   b. Light output from the system contrasts ambient brightness; the brighter the ambient, the dimmer the system
2. Based on user input received for example, from a network coupled device such as the user's mobile device, at 404, the power/control circuit 206 determines the extents of brightness levels the user desires, including a maximum and a minimum.
3. At 406, the power/control circuit 206 tracks the minimum and maximum adjusted ambient brightness observed in the system. As this is a relative reading, the adjusted sensor reading can be negative, depending on how the calibration values were determined.
4. At 408, the power/control circuit 206 determines an offset for output brightness that is determined by the ambient light level at the time the user sets brightness explicitly.
5. At 410, as ambient light levels change, the power/control circuit 206 is configured to computationally respect the user's offset by controlling a lighting unit to adjust the output brightness along a linear curve adjusted up or down by the offset.

Figure 5:
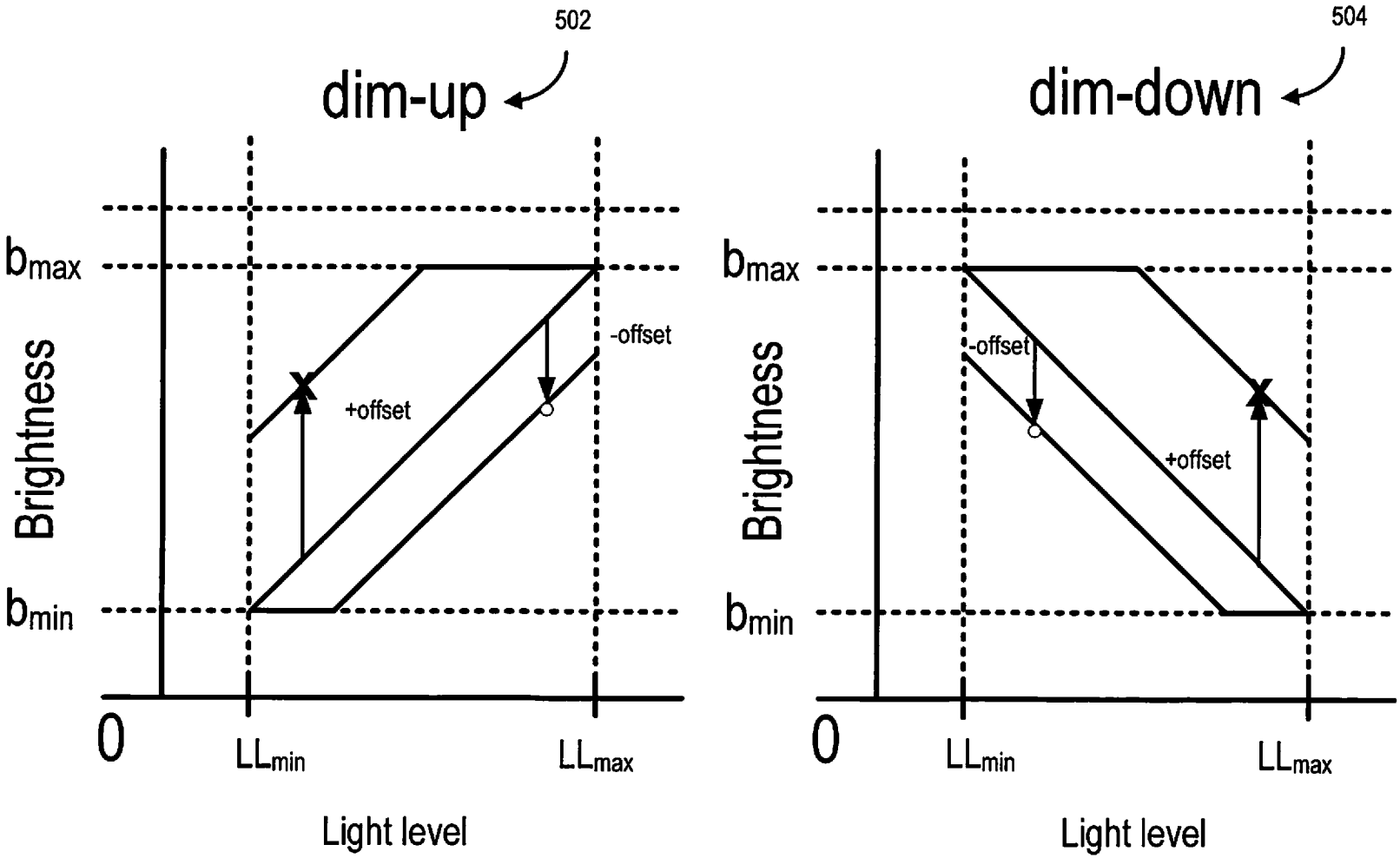
FIG. 5 is a plot showing offset processes for dimming up or dimming down using an example linear adjustment curve, according to some embodiments.

This method is shown in FIG. 5, which illustrates the offset processes 502 and 504 based on a dimming up or a dimming down. As shown in FIG. 5, a linear adjustment curve is shown that is used to shift output characteristics (e.g., brightness) up or down by an offset.

Figure 6:
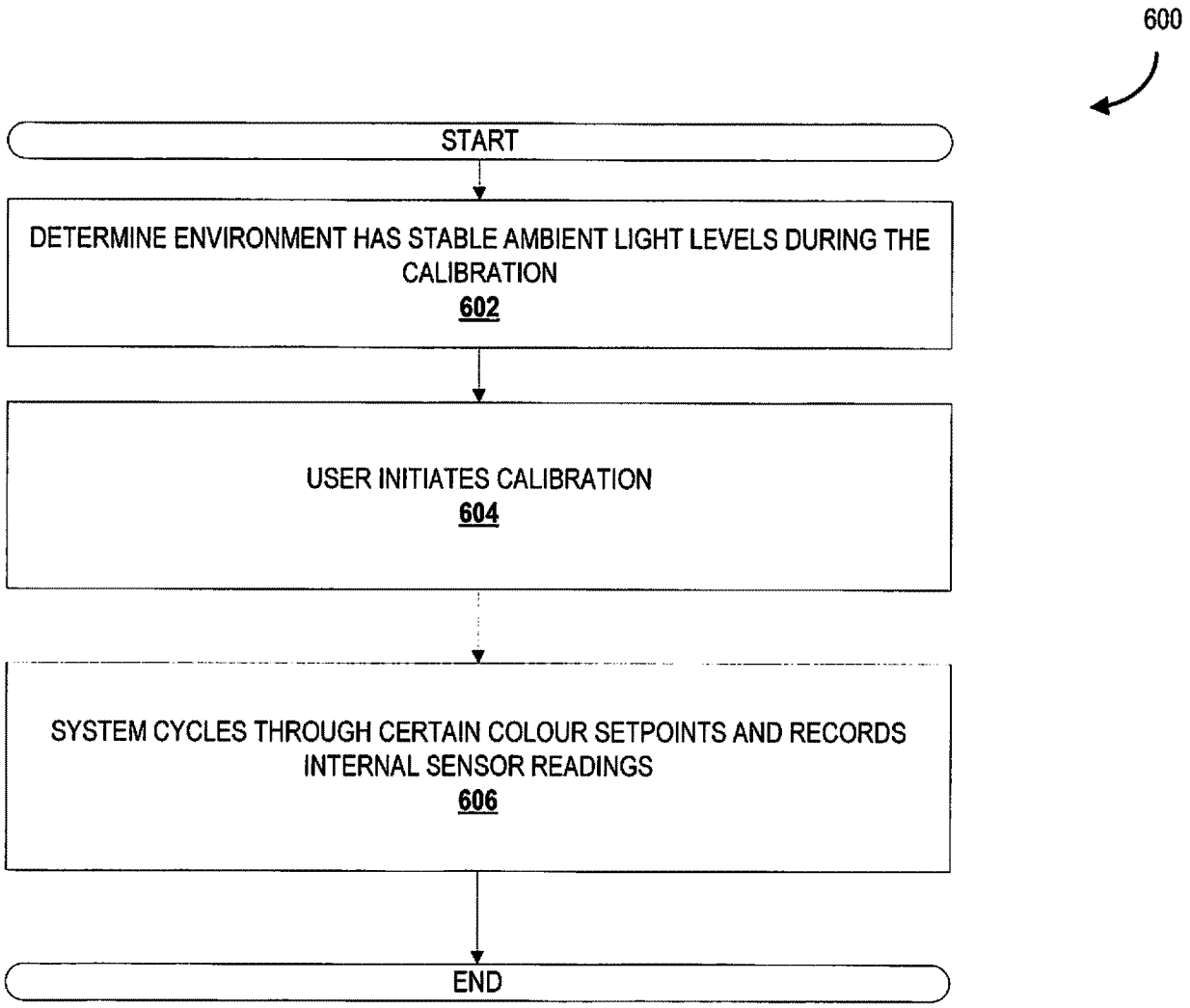
FIG. 6 is a method diagram of a method for calibration of the self-feedback values, according to some embodiments.

At FIG. 6, an example method for calibration of the self-feedback values 600 is illustrated in some embodiments. Because of the relative scales for sensor reading, the calibration does not necessarily need to be performed in a dark environment; the environment just needs have stable ambient light levels during the calibration.

Variations are contemplated, and steps may be conducted in various orders and different, alternate, and modified steps are possible.

The method 600 includes, for example:

1. At 602, the user initiates calibration, for example, by providing a control signal through an application on a mobile device, and the initiation signal is received at the power/control circuit 206;
2. At 604, the system, for example, the power/control circuit 206, cycles through certain colour setpoints and records internal sensor readings; and
3. At 608, the calibration is conducted by the power/control circuit 206 and proceeds until complete.

Figure 7:
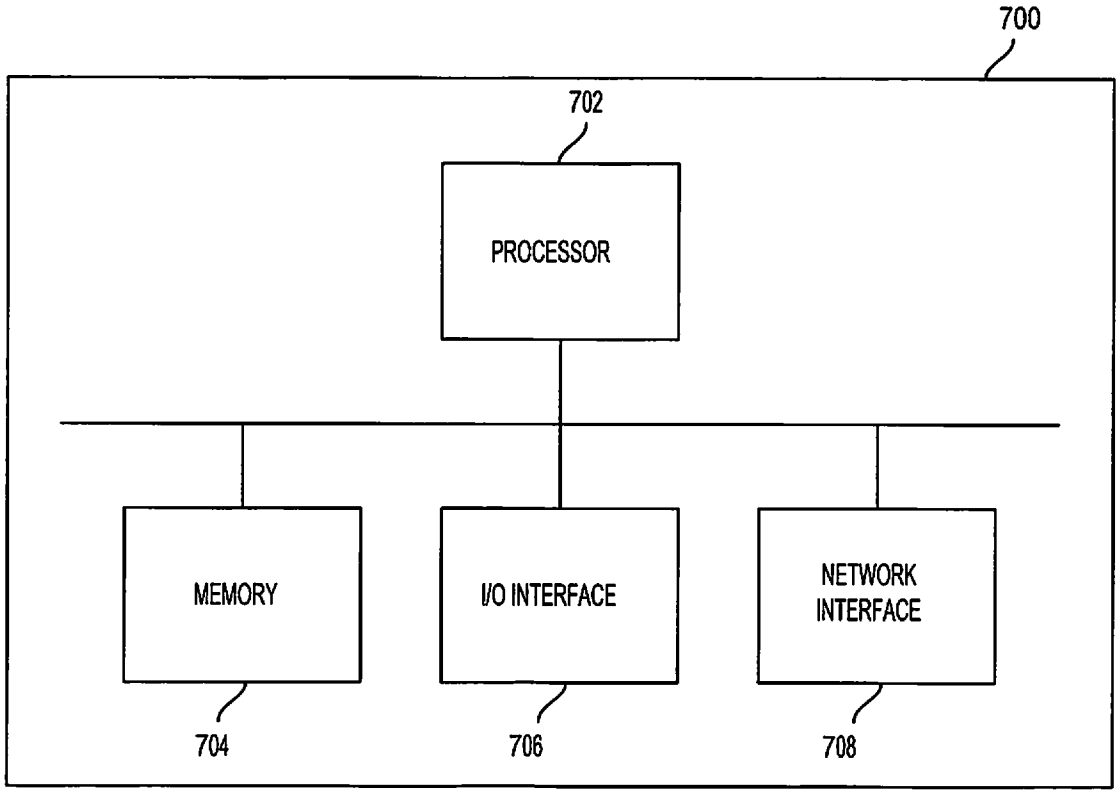
FIG. 7 is an example block schematic of an example computing device, according to some embodiments.

FIG. 7 is an example block schematic of an example computing device 700, according to some embodiments. Computing device 700 can include a processor 702, which can include a microprocessor, a hardware computer processor, among others, and the computing device 700, in some embodiments, is part of or a component of power/control circuit 206.

The processor 702 can include application specific instruction set processors, a computer central processing unit, among others, and can be adapted to process ambient light signals and to generate control signals (e.g., analog or digital signals) for controlling and/or adjusting lighting outputs. Memory 704 can include computer memory, such as random access memory, read only memory, embedded firmware, among others, and can be configured for coupling to processor 702 to store intermediate instructions and/or stored values.

I/O interface 706 can include, for example, input/output ports and/or pins of the computing device 700 for use in receiving sensory inputs or communicating control signals, for example, in the form of analog signals or digital signals, such as data packets. The I/O interface 706 can be coupled with a network interface 708 which can be configured for electronic communications with a network, such as an ad-hoc network of coupled lighting devices, a local area network (LAN), or a wide area network (WAN). The network can provide signals, for example, from a coupled user mobile device.

The term "connected" or "coupled to" may include both direct coupling (in which two elements that are coupled to each other contact each other) and indirect coupling (in which at least one additional element is located between the two elements).

Although the embodiments have been described in detail, it should be understood that various changes, substitutions and alterations can be made herein without departing from the scope. Moreover, the scope of the present application is not intended to be limited to the particular embodiments of the process, machine, manufacture, composition of matter, means, methods and steps described in the specification.

As one of ordinary skill in the art will readily appreciate from the disclosure, processes, machines, manufacture, compositions of matter, means, methods, or steps, presently existing or later to be developed, that perform substantially the same function or achieve substantially the same result as the corresponding embodiments described herein may be utilized. Accordingly, the appended claims are intended to include within their scope such processes, machines, manufacture, compositions of matter, means, methods, or steps.

As can be understood, the examples described above and illustrated are intended to be exemplary only.

What is claimed is:

1. A controller circuit adapted for controlling a light output of a lighting device, the controller circuit comprising:

one or more internal light sensors that are positioned behind optical elements within the lighting device, the lighting device including a front panel having lighting elements emitting light such that the front panel appears to be a uniformly lit panel upon direct view of an observer, the one or more internal light sensors disposed on a rear side of the front panel of the lighting device opposite from a first direction and hidden from the direct view by the observer, the one or more internal light sensors subject to light feedback from the lighting elements of the lighting device;

a processor configured to:

based on a user input value, determine a type of lighting output state desired by a user;

based on the user input value, determine a brightness level desired, including at least a minimum and a maximum value;

track an adjusted ambient brightness level observed by a sensor of the one or more internal light sensors, the tracking including tracking a minimum and a maximum brightness level;

determine an offset for output brightness determined at least by an ambient light level at a time proximate to a time when the user has established a brightness level, the offset adapted to calibrate the output brightness of the lighting device based on the light feedback; and generate signals adapted for controlling the light output of the lighting device to adjust an output brightness of the lighting device along a lighting curve, adjusted based on the offset, the adjustment of the output brightness based on the brightness level desired and corrected based on light feedback from the lighting elements of the lighting device;

wherein the lighting elements are capable of adjustment by transitioning between colors by smoothly interpolating intermediate colors between an initial state color to a target state color, the intermediate colors, the initial state color, and the target state color representing potential output colors of the light output of the lighting device;

wherein the controller circuit is further adapted to adjust the ambient light level responsive to lighting outputs that are in a transition state.

wherein the one or more internal light sensors are configured to generate one or more internal light sensor readings at different output colors in a constant ambient brightness setting, the one or more internal light sensor readings recorded as one or more calibration values; and wherein the processor is further configured to:

determine one or more time periods where a light output of the lighting device is known and stable;

obtain a measurement from a light sensor of the one or more internal light sensors at different available output colors;

determine a calibration value of the one or more calibration values corresponding to the measurement from the light sensor by interpolating the calibration value if a current output color does not have a direct calibration value among the different available output colors;

scale the calibration value with a current user brightness setting value;

subtract the calibration value from the measurement to provide the adjusted ambient light level; and generate signals adapted for controlling the light output of the lighting device during the transition state based at least on the adjusted ambient light level.

2. The controller circuit of claim 1, wherein the one or more internal light sensors are configured to be calibrated responsive to receipt of a corresponding control signal generated from an external device.

3. The controller circuit of claim 2, wherein the external device is a mobile device associated with a user and controllable through a mobile application resident on the mobile device.

4. The controller circuit of claim 2, wherein calibration includes controlling the light output of the lighting device to cycle through one or more color setpoints and recording one or more corresponding internal sensor readings; and wherein the calibration value of the one or more calibration values is determined through the one or more internal sensor readings.

5. The controller circuit of claim 1, wherein the lighting device includes one or more light emitting diodes.

6. The controller circuit of claim 1, wherein the lighting device is modular and adapted to couple to one or more other lighting devices, the lighting device and the one or more lighting devices operating as modules of a lighting system to provide lighting output in concert, each lighting device operating independently of the one or more other lighting devices to provide individually controlled lighting outputs.

7. The controller circuit of claim 6, wherein each lighting device is operable to shift between a plurality of different light outputs including at least different colors and different brightness levels.

8. The controller circuit of claim 1, wherein the one or more internal light sensors include at least one of photoresistors, photodiodes, and phototransistors.

9. A method adapted for controlling a light output of a lighting device coupled to one or more internal light sensors that are positioned behind optical elements within the lighting device, the lighting device including a front panel having lighting elements emitting light such that the front panel appears to be a uniformly lit panel upon direct view of an observer, the one or more internal light sensors disposed on a rear side of the front panel of the lighting device opposite from a first direction and hidden from the direct view by the observer, the one or more internal light sensors subject to light feedback from the lighting elements of the lighting device, the method comprising:

based on a user input value, determining a type of lighting output state desired by a user;

based on the user input value, determining a brightness level desired, including at least a minimum and a maximum value;

tracking an adjusted ambient brightness level observed by a sensor of the one or more internal light sensors, the tracking including tracking a minimum and a maximum brightness level;

determining an offset for output brightness determined at least by an ambient light level at a time proximate to a time when the user has established a brightness level, the offset adapted to calibrate the output brightness of the lighting device due to the light feedback; and generating signals adapted for controlling the light output of the lighting device to adjust an output brightness of the lighting device along a lighting curve, adjusted based on the offset, the adjustment of the output brightness based on the brightness level desired and corrected based on light feedback from the lighting elements of the lighting device;

wherein the lighting elements are capable of adjustment by transitioning between colors by smoothly interpolating intermediate colors between an initial state color to a target state color, the intermediate colors, the initial state color, and the target state color representing potential output colors of the light output of the lighting device;

wherein the method includes adjusting the ambient light level responsive to lighting outputs that are in a transition state;

wherein the method further comprises:

determining one or more time periods where a light output of the lighting device is known and stable;

obtaining a measurement from a light sensor of the one or more internal light sensors:

determining a calibration value of the one or more calibration values corresponding to the measurement from the light sensor by interpolating the calibration value if a current output color does not have a direct calibration value among different available output colors:

scaling the calibration value with a current user brightness setting value;

subtracting the calibration value from the measurement to provide the adjusted ambient light level; and generating signals adapted for controlling the light output of the lighting device during the transition state based at least on the adjusted ambient light level.

10. The method of claim 9, wherein the one or more internal light sensors are configured to be calibrated responsive to receipt of a corresponding control signal generated from an external device.

11. The method of claim 10, wherein the external device is a mobile device associated with a user and controllable through a mobile application resident on the mobile device.

12. The method of claim 10, wherein calibration includes controlling the light output of the lighting device to cycle through one or more color setpoints and recording one or more corresponding internal sensor readings; and wherein the calibration value of the one or more calibration values is determined through the one or more internal sensor readings.

13. The method of claim 9, wherein the lighting device includes one or more light emitting diodes.

14. The method of claim 9, wherein the lighting device is modular and adapted to couple to one or more other lighting devices to provide lighting output in concert, each lighting device operating independently of the one or more other lighting devices to provide individually controlled lighting outputs.

15. The method of claim 14, wherein each lighting device is operable to shift between a plurality of different light outputs including at least different colors and different brightness levels.

16. A non-transitory computer readable medium storing machine interpretable instructions that, when executed by a processor, cause the processor to perform operations for controlling a light output of a lighting device, the operations comprising:

determining a type of lighting output state desired by a user based on a user input value, the type of lighting output state corresponding to the light output of the lighting device, wherein the lighting device includes one or more internal light sensors positioned behind optical elements within the lighting device, wherein the lighting device includes a front panel having lighting elements emitting light such that the front panel appears to be a uniformly lit panel upon direct view of an observer, the one or more internal light sensors disposed on a rear side of the front panel of the lighting device opposite from a first direction and hidden from the direct view by an observer, the one or more internal light sensors subject to light feedback from lighting elements of the lighting device;

determining a brightness level desired by the user based on the user input value, the brightness level including at least a minimum and a maximum value;

tracking an adjusted ambient brightness level observed by a sensor of the one or more internal light sensors, the tracking including tracking a minimum and a maximum brightness level;

determining an offset for output brightness determined at least by an ambient light level at a time proximate to a time when the user has established a brightness level, the offset adapted to calibrate the output brightness of the lighting device based on the light feedback; and generating signals adapted for controlling the light output of the lighting device to adjust an output brightness of the lighting device along a lighting curve, adjusted based on the offset, the adjustment of the output brightness based on the brightness level desired and corrected based on light feedback from the lighting elements of the lighting device;

wherein the lighting elements are capable of adjustment by transitioning between colors by smoothly interpolating intermediate colors between an initial state color to a target state color, the intermediate colors, the initial state color, and the target state color representing potential output colors of the light output of the lighting device;

wherein the operations include adjusting the ambient light level responsive to lighting outputs that are in a transition state;

wherein the operations further comprise:

determining one or more time periods where a light output of the lighting devices is known and stable;

obtaining a measurement from a light sensor of the one or more internal light sensors:

determining a calibration value of the one or more calibration values corresponding to the measurement from the light sensor by interpolating the calibration value if a current output color does not have a direct calibration value among different available output colors;

scaling the calibration value with a current user brightness setting value;

subtracting the calibration value from the measurement to provide an adjusted ambient light level; and generating signals adapted for controlling the light output of the lighting device during the transition state based at least on the adjusted ambient light level.

* * * * *